US005347729A

United States Patent [19]

Meyer

[11] Patent Number: 5,347,729

[45] Date of Patent: Sep. 20, 1994

[54] FOOD AND MATERIALS DRYER

[76] Inventor: Dennis E. Meyer, Rte. 3, Box 48, Falls City, Nebr. 68355

[21] Appl. No.: 174,378

[22] Filed: Dec. 28, 1993

Related U.S. Application Data

[63] Continuation of Ser. No. 974,904, Nov. 12, 1992.

[51] Int. Cl.[5] ..... F26B 11/12

[52] U.S. Cl. ..... 34/180; 34/182; 34/129; 34/137; 366/324

[58] Field of Search ..... 34/128, 129, 130, 137, 34/102, 166, 180, 181, 182, 183, 179, 22, 126, 127; 432/105, 106, 109, 112; 366/324, 234

[56] References Cited

U.S. PATENT DOCUMENTS

| | | | |
|---|---|---|---|
| 937,172 | 10/1909 | Pearson | 34/129 |
| 1,014,748 | 1/1912 | Berry | 34/129 |
| 1,421,283 | 6/1922 | Meakin | 34/129 |
| 1,820,938 | 9/1931 | Clandrow | 34/129 |
| 2,453,278 | 11/1948 | Staples, Sr. et al. | 34/102 |
| 2,727,316 | 12/1955 | Naselli | 34/129 |
| 4,761,897 | 8/1988 | Tazaki et al. | 34/180 |

FOREIGN PATENT DOCUMENTS 61385 5/1923 Sweden .

*Primary Examiner*—Denise Gromada
*Attorney, Agent, or Firm*—John A. Beehner

[57] ABSTRACT

A food and materials dryer having one or more cylindrical hollow rotary tunnels each consisting of an outer cylindrical shell and an inner lining cylinder. The inner lining cylinder has perforations and is mounted substantially concentrically within the outer shell. The inner lining cylinder has an outer diameter less than the inner diameter of the outer shell such that air for drying may be directed between the outer shell and inner lining cylinder, passing through the perforation in the inner lining cylinder for drying material within the inner lining cylinder. Mounted in each inner lining cylinder is an agitating auger which has a central shaft and outwardly projecting helical blades for agitating and moving food products within the inner lining cylinder of a rotary tunnel. Also provided are devices for rotating the auger and devices for directing air for drying through the agitating auger and between the outer shell and inner lining cylinder of each of the rotary tunnels. Air for drying is directed opposite the direction in which food is being moved through the inner lining cylinder to increase drying efficiency. Also, the blades of the augers may include positive and negative feedback diverter vanes which serve to further agitate the food product for increased drying efficiency.

17 Claims, 6 Drawing Sheets

FOOD AND MATERIALS DRYER

CROSS-REFERENCE TO RELATED APPLICATION

This application is a continuation of application Ser. No. 07/974,904 for a Food and Materials Dryer, filed on Nov. 12, 1992, which is presently pending.

BACKGROUND OF THE INVENTION

1. Technical Field

This invention relates to devices for drying food and materials and, more particularly, to a food and materials dryer having a plurality of cylindrical hollow rotary tunnels each having an outer shell, an inner lining cylinder and an agitating auger, drying air being directed through the auger and between the outer shell and inner lining cylinder for drying material being agitated by the auger.

2. Description of the Prior Art

Various devices are known for drying hay, vegetables and other materials. Examples of such devices include Einarsson, U.S. Pat. No. 2,368,811, which discloses an apparatus for drying hay, vegetables, fish and the like comprising three compartments with spiral screws in each of them. Einarsson, however, discloses that air for drying is directed only into the central cylinder holding the spiral screw, which means that air cannot dry material at the far end of the spiral screw. Therefore, the majority of drying must be accomplished at the last segment of the spiral screw where air from the fan is blowing thereon, which may result in insufficient drying. Also, Einarsson does not disclose any agitating means other than a standard auger design, which may further restrict drying efficiency.

Another example found in the prior art is British Patent No. 926,877, issued to Rathery on May 22, 1963, which discloses an apparatus for drying grain comprising auger conveyors. Control means are provided for controlling the supply of hot air or gas to vary the heating of the material to be dried. However, once again, the material cannot be uniformly dried as air cannot reach some material in areas far from the air directing means.

Therefore, there is a need for a food and materials dryer which may efficiently dry a large amount of material placed therein.

Another problem encountered in using drying devices of the prior art is that the majority of such devices occupy a great deal of floor space in a plant, which results in wasted space and increased costs for the plant. Plants determine their cost by floor space, so it would be cost-efficient to stack devices to perform the same operations as can be performed by devices extending over a great deal of floor space. Presently, many of the drying processes used in plants involve very long conveyor belt screens which extend from 50 to 300 feet in length. Such drying processes are extremely cost-inefficient. There is therefore a need for a cost-efficient drying process which will occupy a minimum of floor space.

Therefore, an object of the present invention is to provide an improved food and materials dryer.

Another object of the present invention is to provide a food and materials dryer which may efficiently use floor space in a plant.

Yet another object of the present invention is to provide a food and materials dryer having an outer shell and an inner lining cylinder such that air may be directed between the outer and inner cylinders allowing food and materials at the far end of the cylinder to be dried in addition to materials at the near end of the cylinder.

Still another object of the present invention is to provide a food and materials dryer which may provide means for independently adjusting the rate flow, the temperature of the air and the rate of rotation of each auger.

Finally, an object of the present invention is to provide a food and materials dryer which is durable in construction and safe and efficient in use.

SUMMARY OF THE INVENTION

The present invention provides a food and materials dryer consisting of one or more cylindrical hollow rotary tunnels each having a center longitudinal axis. Each rotary tunnel consists of an outer cylindrical shell having an inner surface and an inner lining cylinder having inner and outer surfaces and perforations in the cylinder walls. The inner lining cylinder is mounted substantially concentrically with the center longitudinal axis of the rotary tunnel and within the outer shell. The outer diameter of the inner lining cylinder is smaller than the inner diameter of the outer shell such that air for drying may be directed between the outer shell and inner lining cylinder, passing through the perforations in the inner lining cylinder for drying material within the inner lining cylinder. For moving food and materials through the rotary tunnels and agitating the food and materials, one or more agitating augers each having a center shaft and outwardly projecting helical blades are rotatably mounted coaxially with the longitudinal center axis of the rotary tunnel and within the inner lining cylinder. The helical blades extend outwards to adjacent the inner surface of the inner lining cylinder. For rotating the central shaft of each of the agitating augers, a power device is provided. Food thus placed within one of the rotary tunnels may be moved through the inner cylinder generally parallel to the center longitudinal axis of the rotary tunnel towards an end of the rotary tunnel.

Finally, one or more air directing devices are provided for directing air for drying through the auger and between the outer shell and inner lining cylinder of each of the rotary tunnels. The air for drying is directed opposite the direction in which food is being moved through the inner cylinder in order to increase drying efficiency.

A plurality of rotary tunnels may be stacked one atop another to conserve floor space in a plant, thus making the dryer more cost-efficient.

Also, to increase the drying efficiency of the food and materials dryer of the present invention, the helical blades of the agitating augers may be specially constructed to have one or more pickup diverter vanes and one or more negative drop diverter vanes formed in each segment of the auger. The pickup diverter vanes consist of an arcuate cut formed in a segment and the cut piece being folded outwards from the plane of the segment to form a pickup diverter vane. A negative drop diverter vane consists of an arcuate cut formed in a segment between 45 degrees and 180 degrees away from a cut for a pickup diverter vane, the cut piece being folded inwards from the plane of the segment opposite the direction of folding for a pickup diverter vane, thus forming a negative drop diverter vane.

The present invention thus provides a cost and time-efficient food and materials dryer for use in drying a variety of materials. Air directed between the outer shell and inner lining cylinder allows the materials placed at the far end of the cylinder to be dried with a greater rate of efficiency than any device found in the prior art provides. Furthermore, as the rotary tunnels of the present invention may be stacked one atop another, cost-efficiency is increased to a level higher than that previously attainable with devices in the prior art. The present invention thus provides a substantial improvement over other such devices in the prior art.

DESCRIPTION OF THE PREFERRED EMBODIMENT

Figure 3:
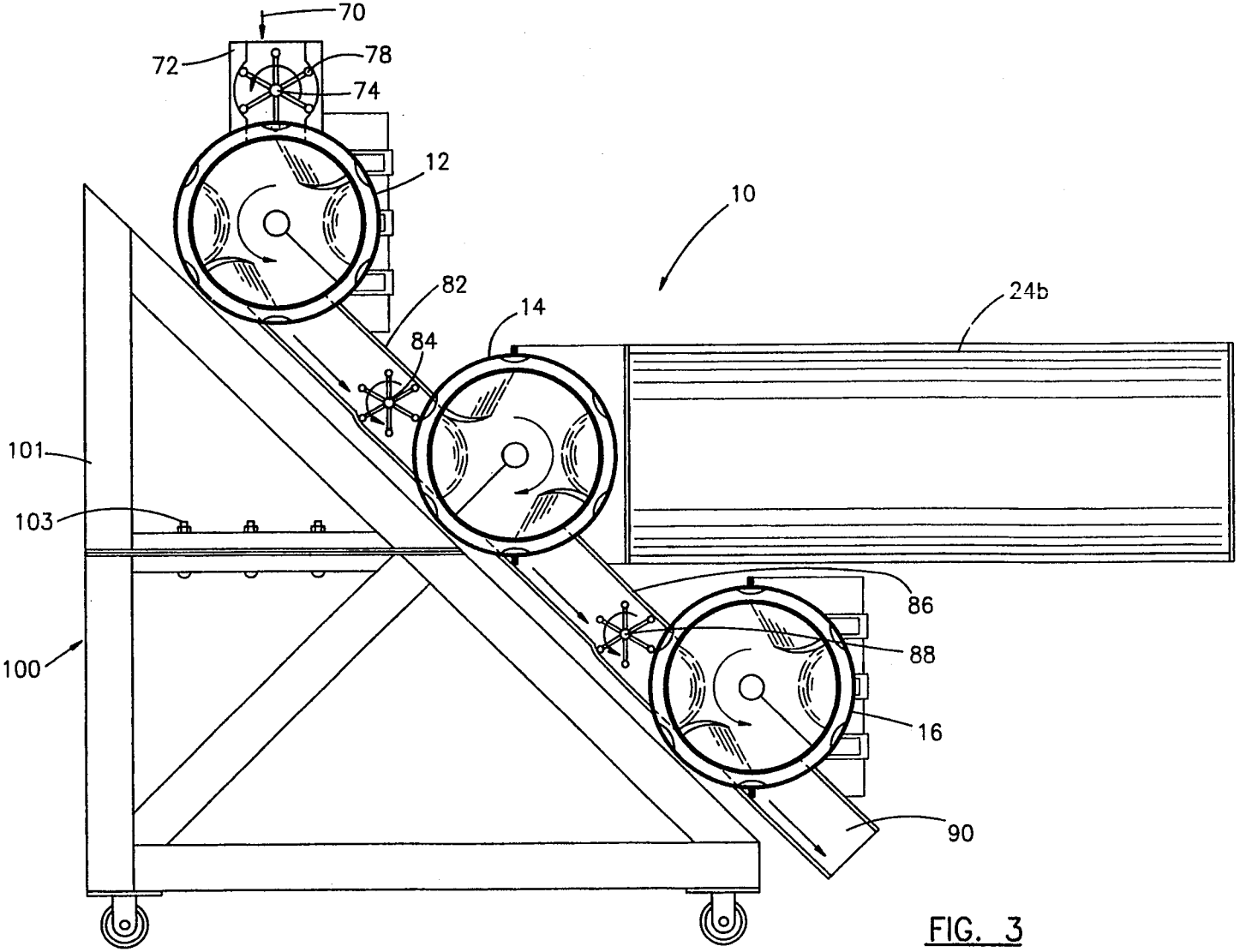
FIG. 3 is a sectional end view of the food dryer showing the impellers for dispensing of food product into each rotary tunnel.
Figure 4:
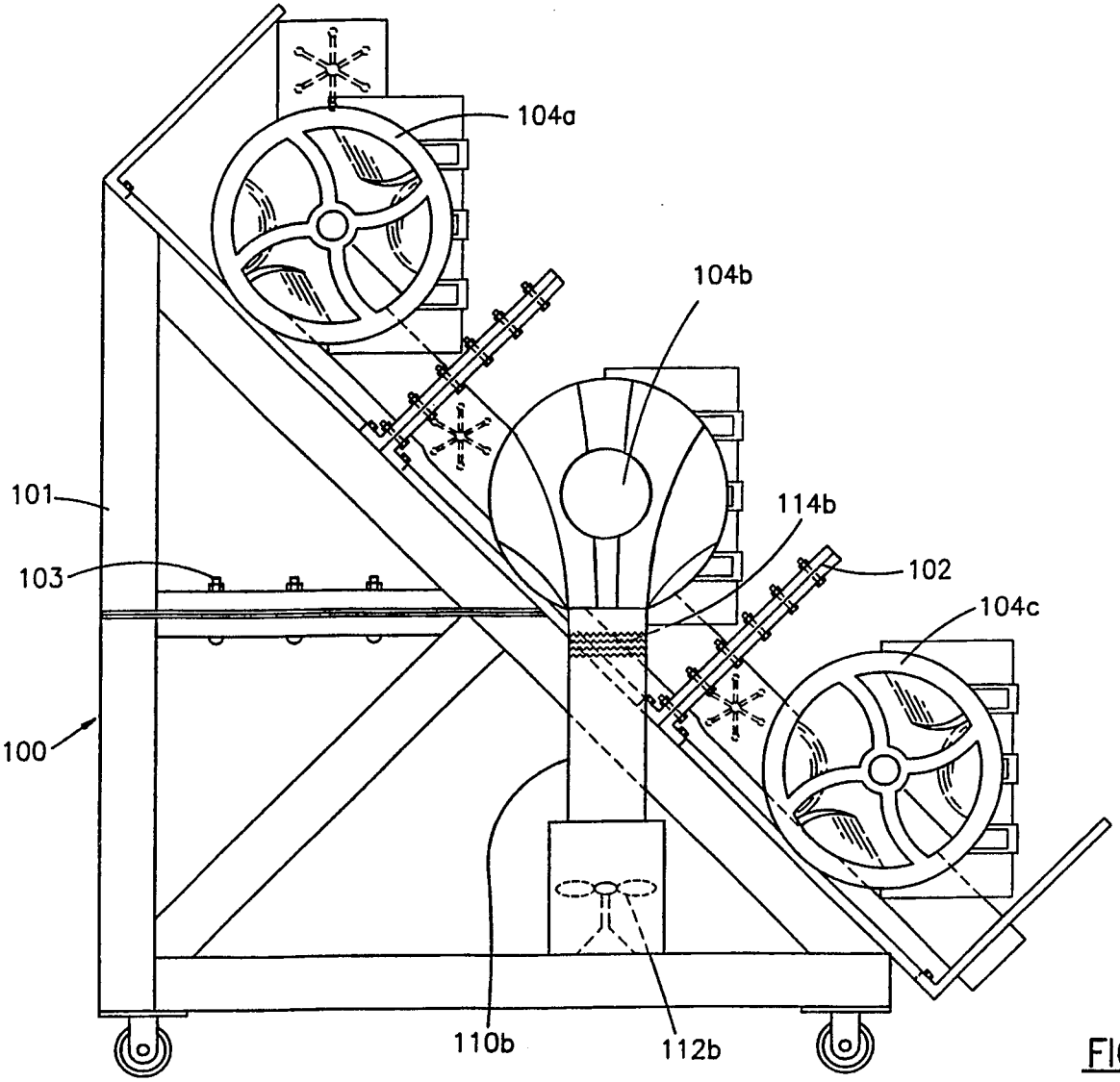
FIG. 4 is an end view showing the open ends of the rotary tunnels.

In a preferred embodiment of the food and materials dryer 10, the upper rotary tunnel 12, middle rotary tunnel 14 and lower rotary tunnel 16 are arranged as depicted in FIGS. 3 and 4 as aligned on a plane defined by the center longitudinal axes of the rotary tunnels, the plane being tilted at a 45-degree angle from horizontal. Each of the rotary tunnels 12, 14 and 16 are preferably constructed in the same manner, therefore, the following description of the upper rotary tunnel 12 should be understood as pertaining to all three rotary tunnels 12, 14 and 16.

The upper rotary tunnel 12 is preferably constructed as shown in FIGS. 1, 2, 8 and 9 as including an outer cylindrical shell 18 having a rear half 20 and a front half 22. The front half 22 of the shell 18 is further divided into a pair of doors **24*a* and 24*b* which are hinged at opposite ends of the outer shell 18, the hinge axis proceeding perpendicularly to the central longitudinal axis of the outer shell 18. Between the doors 24*a* and 24*b* at approximately the midpoint of the outer shell 18 is a door latch mount 26 which is a piece of the front half 22 of the shell 18 which is permanently connected to the rear half 20 of the shell 18. For securing the doors in a closed position, two pairs of latches 28*a*, 28*b*, 30*a* and 30*b* are provided, one pair on each of the doors 24*a* and 24*b*. Inclusion of these doors is vitally important to use of the present invention in drying foods for human consumption, as health requirements mandate regular cleaning of the drying apparatus. The doors 24*a* and 24*b*** allow for a more thorough cleaning job to be performed while at the same time lessening the effort required.

In a preferred embodiment, the outer shell 18 is preferably constructed of a medium to heavy gauge sheet metal formed into the desired cylinder shape with the joints between the front half 22 and rear half 20 of the shell 18 being substantially fluid-tight to substantially eliminate loss of air for drying, which may result in inefficiency.

Figure 8:
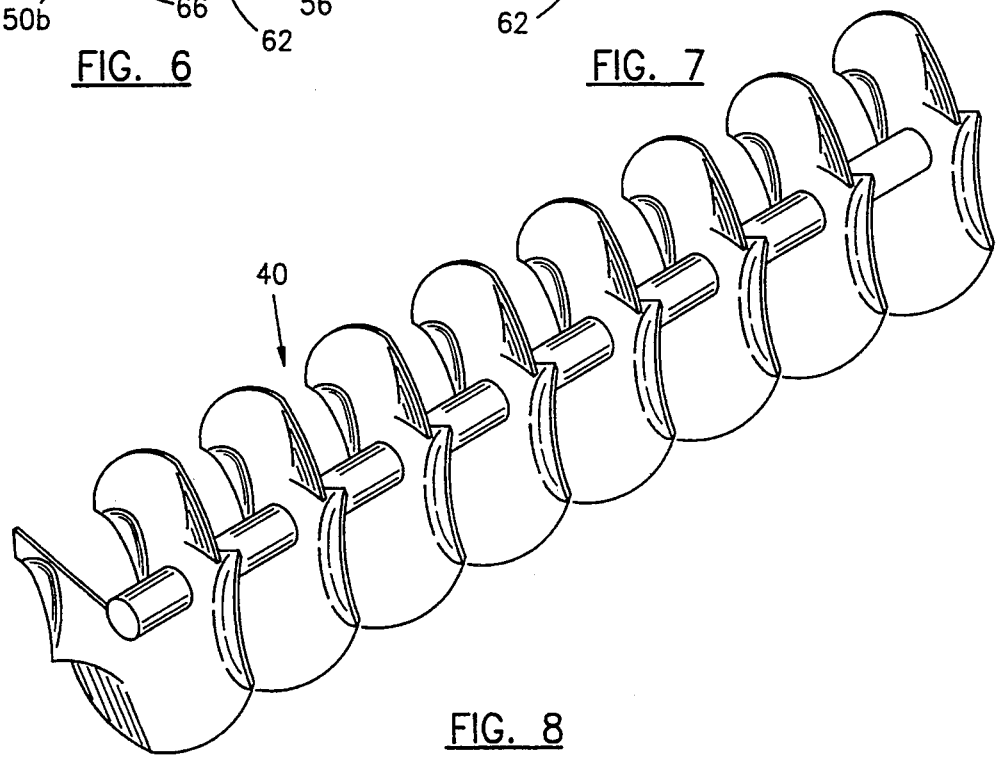
FIG. 8 is a partial perspective view of one auger of the invention.
Figure 9:
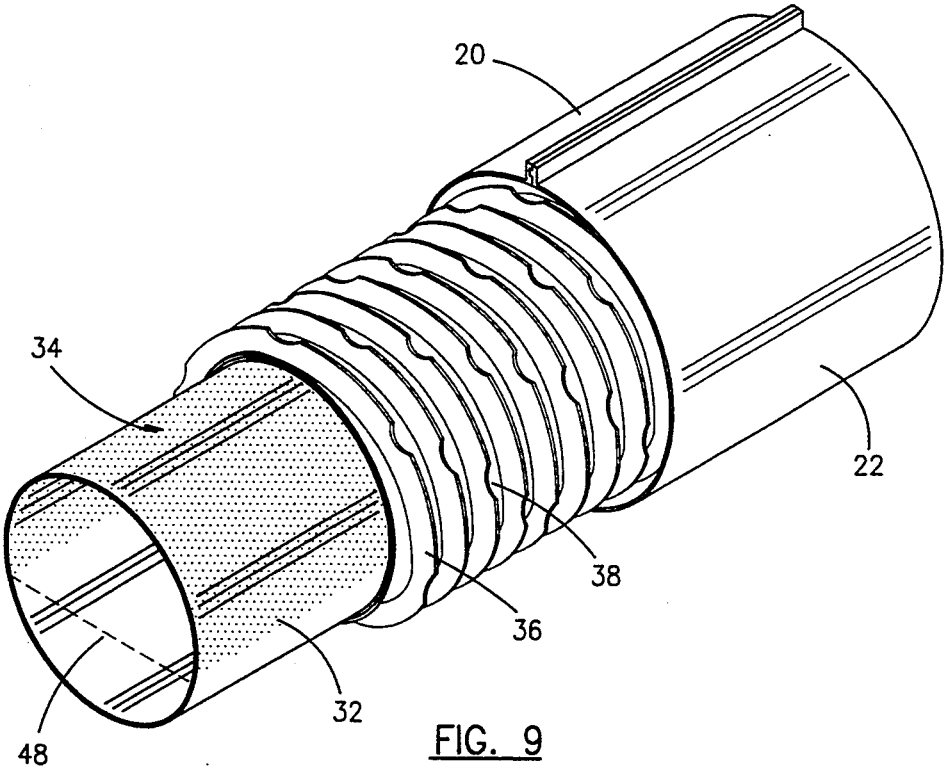
FIG. 9 is an enlarged, partially foreshortened perspective view illustrating the inner lining cylinder having perforations and spiral flighting mounted on the outer surface thereof for diverting air flow into the inner lining cylinder.
Figure 10:
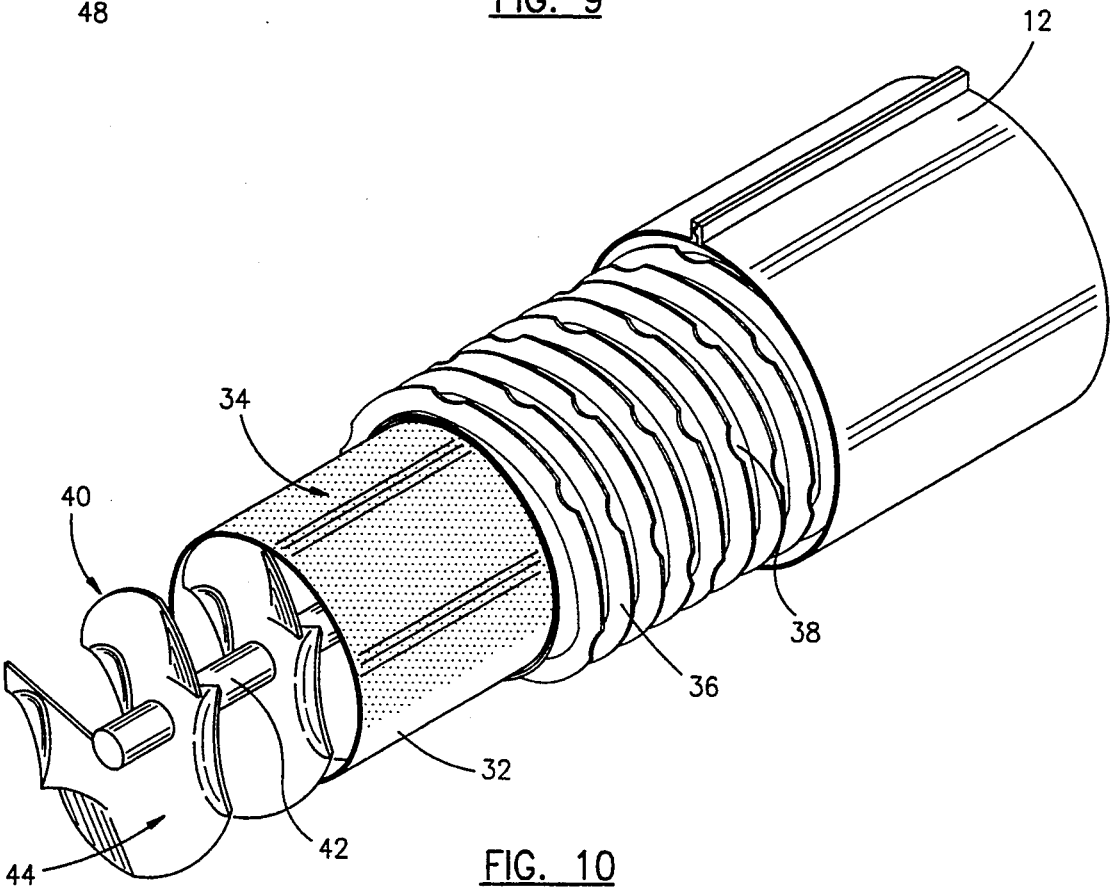
FIG. 10 is a partial perspective view similar to FIG. 9, but exhibiting the auger situated within the inner lining cylinder.

Mounted within the outer shell 18 is an inner lining cylinder 32 which is shown in FIGS. 8 and 9 as including a plurality of perforations 34 formed in the walls of the inner lining cylinder 32. The perforations 34 are preferably formed only above the dotted line 48 shown in FIG. 8 and are of a size to allow free air passage therethrough but to prevent solids such as grains or food from passing through. Mounted on the outer surface of the inner lining cylinder 32 is spiral flighting 36, shown in FIGS. 2, 8 and 9, which deflects air flow passing between the outer shell 18 and inner lining cylinder 32 into the center of the inner lining cylinder 32. As can most clearly be seen in FIG. 8, each of the segments of the spiral flighting 36 has a plurality of arcuate cuts 38 removed from the outer edge of each segment. These arcuate cuts 38 allow air for drying to pass along the channel formed between the outer shell 18 and inner lining cylinder 32 while much of the air is diverted into the interior of the inner lining cylinder 32. It is preferred that between 15 and 40 percent of the air directed for drying pass through the arcuate cuts 38, as this will produce optimum drying conditions. It is also preferred that the arcuate cuts 38 on one segment be staggered approximately 10°–20° from the arcuate cuts 38 on the following segment such that air may be better deflected. Also, it is preferred that the spiral flighting segments be sloped at approximately 60° to further direct airflow into the inner lining cylinder. As shown in FIG. 8, the spiral flighting extends between the inner lining cylinder 32 and outer cylindrical shell 18. It is preferred that the spiral flighting 36 be constructed of a relatively thin sheet metal or plastic for weight and expense reasons, yet be sufficiently rigid to support the inner lining cylinder 32 within the outer shell 18. It is preferred that the inner lining cylinder 32 be constructed of a relatively rigid metal in the case of preparing such products as dog food or materials not for human consumption, and of stainless steel in application where products for human consumption are to be dried.

Figure 7:
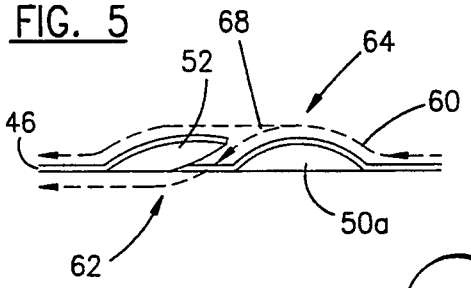
FIG. 7 is a linear diagrammatic illustration of the paddles and dish formations in the auger segments as seen along line 7—7 in FIG. 5.

Housed within the inner lining cylinder 32 is an agitating auger 40 pictured in FIGS. 7 and 9 as including a central shaft 42 and a helical blade 44, the helical blade 44 having a plurality of segments 46. The central shaft is preferably rotatably mounted along the center longitudinal axis of the rotary tunnel 12 such that the helical blades 44 are adjacent the inner surface of the inner lining cylinder 32. Rotation of the auger 40 is accomplished by rotating the central shaft 42 about the center longitudinal axis of the central shaft 42. Rotation of the auger 40 may move material or food placed in the inner lining cylinder 32 towards one end or another of the rotary tunnel 12 depending on the direction of rotation of the central shaft 42. In a preferred embodiment, material placed within the inner lining cylinder 32 a depth no greater than that shown by the dotted line 48 in FIG. 9. Otherwise, the drying apparatus of the present invention will not function at maximum efficiency, possibly leaving some material not completely dried.

Figure 5:
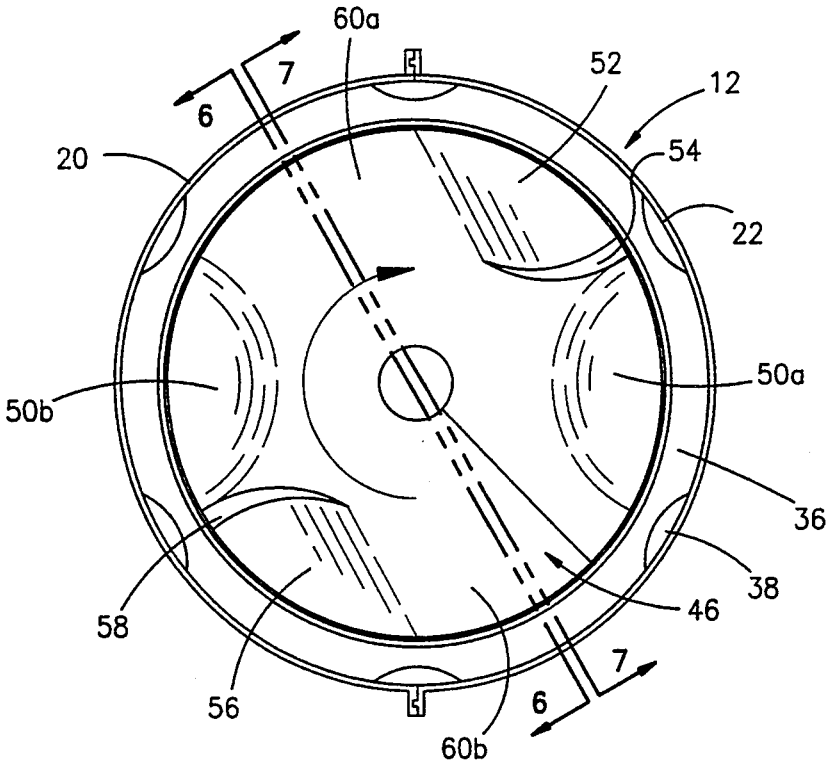
FIG. 5 is an enlarged detail sectional view of a rotary tunnel.
Figure 6:
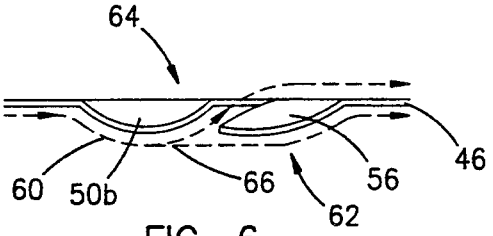
FIG. 6 is a linear diagrammatic illustration of the paddles and dish formations in the auger segments as seen along line 6—6 in FIG. 5.

As is best shown in FIGS. 5–8, each helical blade segment 46 preferably comprises a pair of lead embedments 50*a* and 50*b* formed in each segment 46 approximately 180 degrees apart. The lead embedments 50*a* and 50*b* are each preferably constructed as arcuate sections bent respectively inwardly and outwardly from the plane of the segment 46 as shown in FIGS. 6 and 7. Formed adjacent lead embedment 50*a* is a positive feedback diverter vane 52, shown in FIG. 7, which consists of an arcuate cut 54 formed in the segment 46, the resulting section of the segment 46 being bent inwards from the plane of the segment 46 such that the positive feedback diverter vane 52 extends in the same direction as lead vane 50*a* and opposite the direction in which lead vane 50*b* extends.

Formed adjacent the opposite lead vane 50*b* is a negative drop diverter vane 56, shown in FIG. 6, formed in the same manner as the positive feedback diverter vane 52 in that an arcuate cut 58 is formed in the segment 46, the resulting section being folded in the same direction as lead vane 50*b*, thus forming a negative feedback diverter vane. The 60 degree segment remaining on each segment 46 of the helical blade 44 remains a straight notch piece 60*a* and 60*b*, as shown in FIG. 5.

This helical blade design provides a mild agitation to food placed within the inner lining cylinder 32 which results in a more efficient drying process, without causing damage to the food. As shown in FIGS. 5–7, food 60 (shown as the dotted lines) is being moved by the auger 40 towards the top of the drawing page for FIGS. 6 and 7 and out of the page for FIG. 5. The top side 62 of the segment 46 will be referred to as the positive side of the segment 46, and the rear side will be referred to as the negative side 64. Food 60 is being moved by the auger and as an element of that motion is agitated by the lead embedment 50*b* as it passes through the food 60 at the lower section of the inner lining cylinder 32. Part of the food 60 on the positive side 62 of the segment 46 is directed to the negative side 64 of the segment 46 by the negative feed back diverter vane 56 thus further agitating the food 60. This is shown in FIG. 6 by the divided arrow 66. As the auger 40 rotates, some of the food 60 on the negative side 64 is drawn over to the positive side 62 by the positive feedback diverter vane 52 after encountering the lead vane 50*a*. This is shown in FIG. 7 by the divided arrow 68.

As the auger 40 is designed to be rotated at a speed between two and five revolutions per minute, the diverter vanes 52 and 56 and lead vanes 50*a* and 50*b* will cause substantially no damage to food products being dried in the inner lining cylinder 32. It is this mild agitation which enables the food drier 10 of the present invention to achieve maximum efficiency. Food may be exposed to a greater amount of drying air, which may decrease the time needed to fully dry a food product.

FIGS. 3 and 4 illustrate the preferred organization of the three rotary tunnels 12, 14 and 16. The direction of food movement is shown by the straight arrows in FIGS. 1 and 3. Food is fed into the upper rotary tunnel 12 through an inlet port 70 which consists of a spreader bay 72 which houses an impeller 74 connected to an impeller drive unit 76. The impeller 74 has vanes 78 which contact the inner surface of the spreader bay 72 thus forming a generally air-tight seal. Food product may thus be fed into the upper rotary tunnel 12 without losing appreciable amounts of drying air.

Figure 1:
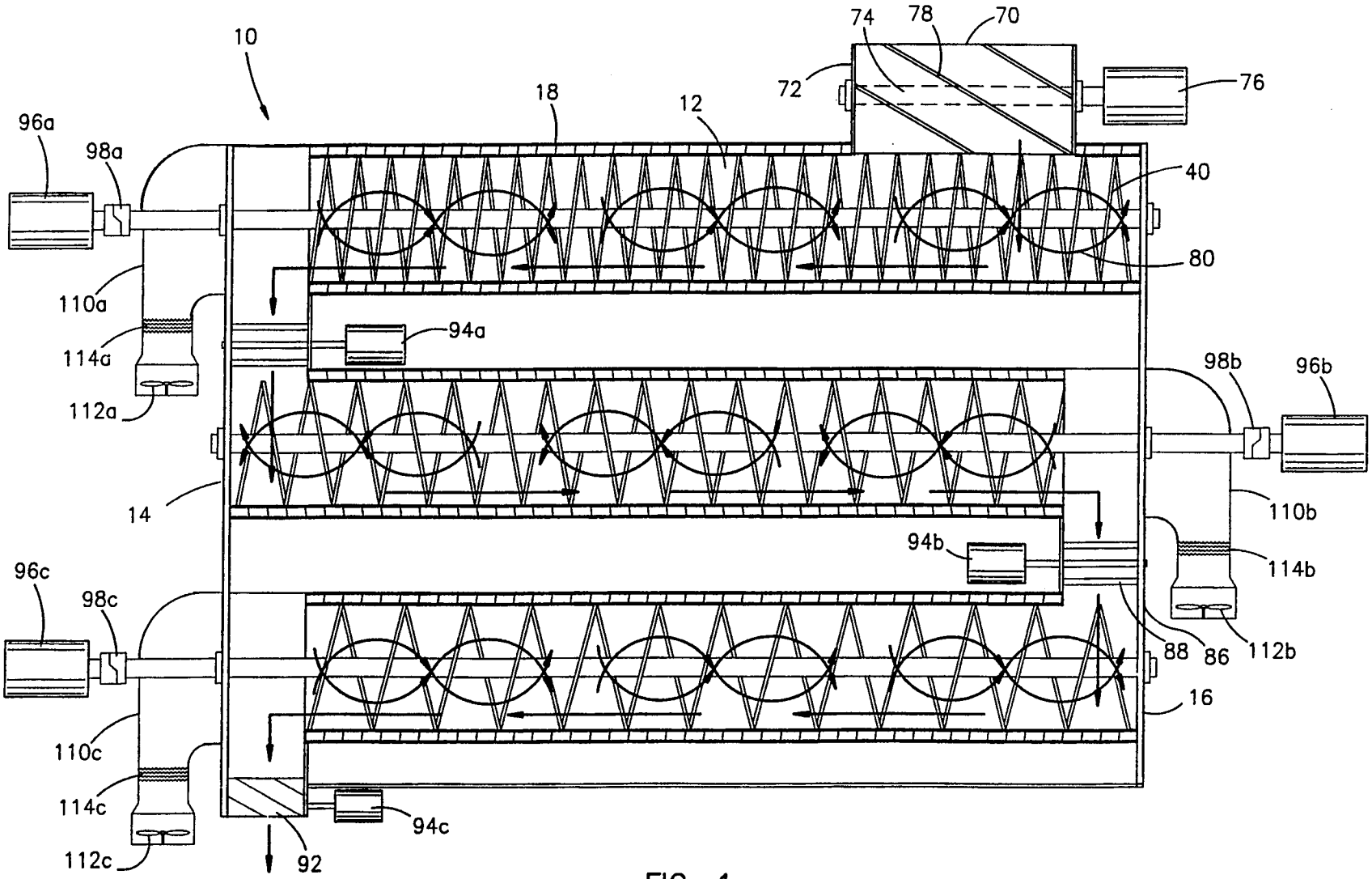
FIG. 1 is a side sectional view of all three auger tubes with straight arrows indicating the direction of food product movement and arcuate arrows indicating the opposite air flow direction.
Figure 2:
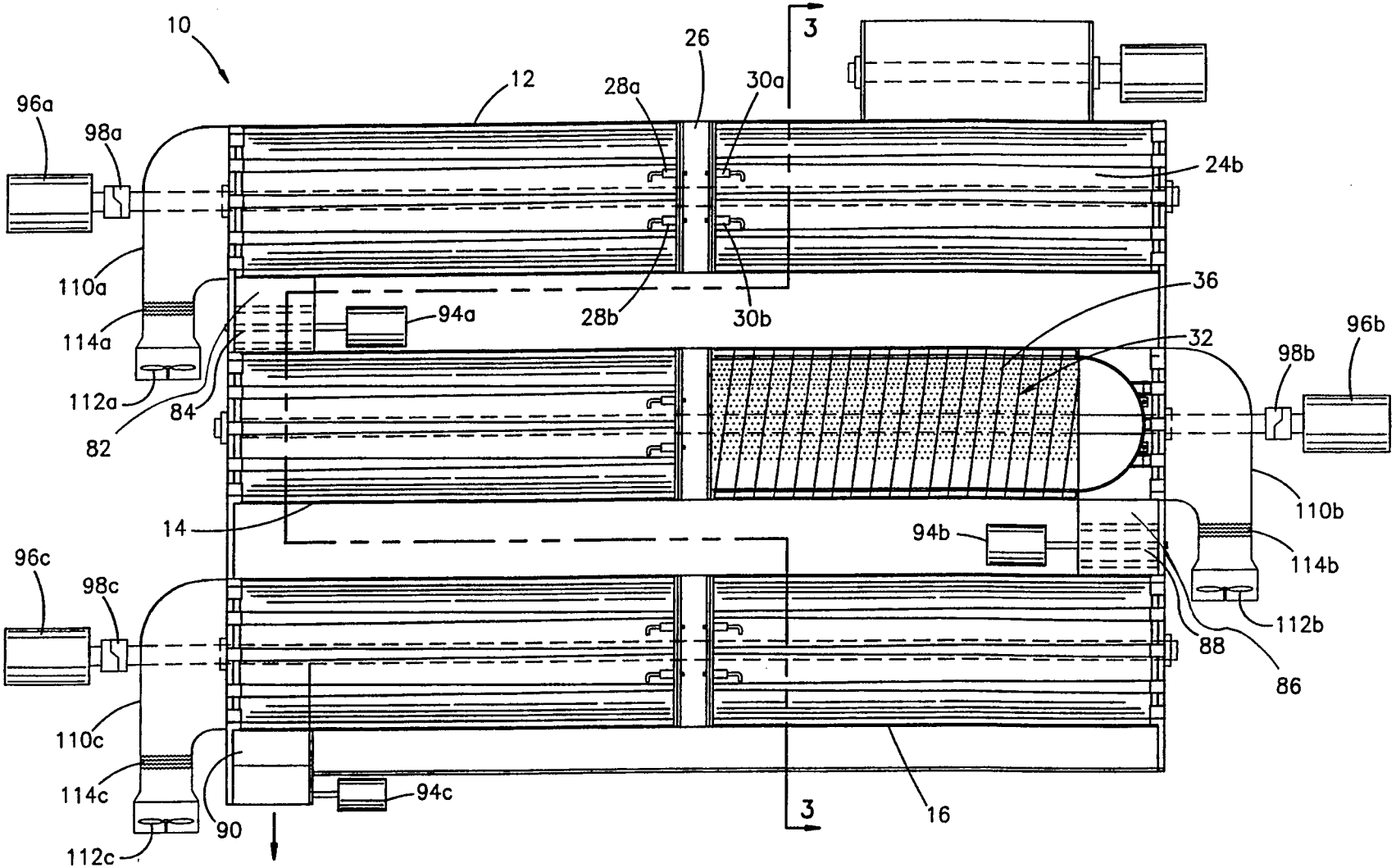
FIG. 2 is a side view of the dryer showing the doors over each auger section but with the doors removed from the right center auger section to expose the structure therein.

Once the food product enters the upper rotary tunnel 12, it is moved towards the opposite end of the rotary tunnel 12 by the rotating action of the auger 40. At the same time, air is forced into the inner lining cylinder 32 to accelerate the drying process. The air motion is depicted in FIG. 1 by the arcuate arrows 80. As can clearly be seen, air flow direction is opposite the direction of food product movement, which substantially increases the drying efficiency of the food dryer 10 of the present invention. As food approaches the end of the upper rotary tunnel 12, it slides down a chute 82, as shown in FIG. 3, into another impeller 84 which feeds the food into the middle rotary tunnel at a controlled rate. Furthermore, the impeller 84 acts as an airlock similar to the impeller 74 which feeds the upper rotary tunnel 12. Drying air from the middle rotary tunnel 14 thus cannot enter the upper rotary tunnel 12. In similar fashion, food is transported through the middle rotary tunnel 14 to a chute 86 which leads to another impeller 88 which feeds food into the lower rotary tunnel 16. The food product is then pushed through the lower rotary tunnel by another auger 40 and exits through a drop chute 90 having an outlet impeller 92 which acts as a final airlock.

For pushing air into each of the rotary tunnels, 12, 14 and 16, three separately controllable fans 112*a*, 112*b* and 112*c* are provided. The fans 112*a*, 112*b* and 112*c* are connected to the rotary tunnels 12, 14, and 16 by a trio of air ducts 110*a*, 110*b* and 110*c* which are preferably tunnels having a diameter equal to that of each rotary tunnel 12, 14 and 16 such that the air ducts 110*a*, 110*b* and 110*c* may be connected to the rotary tunnels 12, 14 and 16.

For providing heated air for drying, each air duct and fan unit may further include a heating unit 114*a*, 114*b* and 114*c*, which may heat air passing therethrough. Each heating unit 114*a*, 114*b* and 114*c* would likewise be independently controllable as to heat output.

Orbit drive units 94*a*, 94*b* and 94*c* are provided for driving the various impellers 84, 88 and 92. For rotating the three augers 40 of the rotary tunnels 12, 14 and 16, three auger drive motors 96*a*, 96*b* and 96*c* are provided, each motor mounted to the central shaft 42 of the associated auger 40 through a drive coupler 98*a*, 98*b* and 98*c*.

The three rotary tunnels 12, 14 and 16 are preferably mounted on an A-frame support 100 which supports the rotary tunnels in the desired configuration. Mounting brackets 102 are provided on the slanted surface of the A-frame support 100 for securing the rotary tunnels 12, 14 and 16 in position. To allow for easy transport of the A-frame support 100, the top section 101 of the A-frame may be removed by releasing the connecting bolts 103. For releasing the drying air as it passes through the rotary tunnels 12, 14 and 16, each rotary tunnel has at an end opposite the airflow input end a spiraled bearing support 104*a*, 104*b* and 104*c* which allows the drying air to exit the rotary tunnels 12, 14 and 16. The elements just described can best be seen in FIG. 4.

An important element of the drying process is that the augers in each of the rotary tunnels 12, 14 and 16 have different pitches on their helical blades. Specifically, the auger 40 in the upper rotary tunnel 12 preferably has approximately one half of the pitch of the auger 40 in the lower rotary tunnel 16 while the auger 40 in the middle rotary tunnel 14 has three-quarters of the pitch of the auger 40 in the lower rotary tunnel 16. This results in approximately 50% of the drying of a food product taking place in the upper rotary tunnel 12, 30% of the drying of a food product taking place in the middle rotary tunnel 14 and 20% of the drying of a food product taking place in the lower rotary tunnel 16. The varying pitches of the augers may best be seen in FIG. 1.

It is contemplated that the preferred dimensions of the food and materials dryer 10 be as follows:

Length of each rotary tunnel - 20'-30'
Diameter of each rotary tunnel - 3'-5'
Distance between each rotary tunnel - 2'-3'
Diameter of perforated holes - 1/6"-¼"
Expected drying capacity - 48,000 lbs/hr.

The food dryer 10 of the present invention thus provides a substantial improvement over dryers found in the prior art.

It is to be understood that the above description is not intended in any way to limit the scope of the present invention, which shall follow from the claims set forth below.

There has thus been set forth and described an invention which accomplishes at least all of the stated objectives.

I claim:

1. A food and materials drying comprising:

at least one cylindrical hollow rotary tunnel having a center longitudinal axis, comprising:

an outer cylindrical shell having an inner surface;

an inner lining cylinder having a wall with inner and outer surfaces and perforations formed in said wall of said cylinder, said inner lining cylinder mounted substantially concentrically within said outer shell, said inner lining cylinder having an outer diameter smaller than the inner diameter of said outer shell whereby air for drying may be directed between said outer shell and said inner lining cylinder and pass through said perforations in said inner lining cylinder for drying material within said inner lining cylinder;

at least one agitating auger having a central shaft and outwardly projecting helical blades mounted on said central shaft, one auger in each center rotary tunnel, each mounted coaxially with said center longitudinal axis of said rotary tunnel and within said inner lining cylinder;

said helical blades extending outwards to adjacent said inner surface of said inner lining cylinder;

agitating means mounted on each of said agitating augers, said agitating means operative to agitate food within said inner lining cylinder whereby increased drying efficiency is obtained;

means for rotating said central shaft of each of said agitating augers whereby food placed within each rotary tunnel may be moved through said inner cylinder generally parallel to said center longitudinal axis towards an end of said rotary tunnel;

means for directing air for drying through said agitating auger and between said outer shell and said inner lining cylinder of each of said rotary tunnels;

air diverting means mounted on one of said inner lining and outer cylinders, said air diverting means mounted between said inner lining and outer cylinders, said air diverting means operative to divert air directed between said outer and inner lining cylinders into and through said perforations in said inner lining cylinder and into said inner lining cylinder for drying material therein, and said air being directed opposite the direction in which food is being moved through said inner lining cylinder whereby drying efficiency may be increased.

2. The food and materials dryer of claim 1 wherein said outer cylindrical shell further comprises a pair of half-cylinder sections connected to each other to form said outer shell.

3. The food and materials dryer of claim 1 wherein said outer shell further comprises at least one door whereby access to said inner lining cylinder and said auger for cleaning and repairing may be gained.

4. The food and materials dryer of claim 1 wherein said air diverting means comprises spiral flighting having a plurality of segments each having an outer edge and a plurality of arcuate sections removed from said outer edge, said spiral flighting mounted on said outer surface of said inner lining cylinder, said spiral flighting mounted concentrically with said center longitudinal axis of said rotary tunnel, said spiral flighting extending outwards to adjacent said inner surface of said outer shell whereby air passing between said outer shell and said inner lining cylinder may be deflected through said perforations and into said inner lining cylinder thereby increasing drying efficiency in said rotary tunnels.

5. The food and materials dryer of claim 1 wherein said perforations comprise a plurality of small holes formed in said inner lining cylinder and communicating between said inner and outer surfaces of said inner lining cylinder, said holes formed such that material within said inner lining cylinder is restricted from passing therethrough while air and moisture may pass through.

6. The food and materials dryer of claim 1 wherein each of said helical blades further comprises a plurality of angled, disk-shaped connected segments forming said helical blade and each of said disk-shaped connected segments defining a plane.

7. The food and materials drying of claim 6 wherein said agitating means comprises at least one pickup diverter vane formed in said segment and at least one negative drop diverter vane formed in said segment.

8. The food and materials dryer of claim 7 wherein said pickup diverter vanes comprise an arcuate cut formed in said segment, the cut piece being folded outwards from said plane of said segment to form said pickup diverter vane.

9. The food and materials dryer of claim 8 wherein said negative drop diverter vanes comprise an arcuate cut formed in said segment between 45° and 180° away from said cut for said pickup diverter vanes, the cut piece being folded inwards from said plane of said segment, opposite said pickup diverter vane, thereby forming said negative drop diverter vane.

10. The food and materials dryer of claim 1 wherein said means for rotating said central shaft of each of said agitating augers further comprise at least one orbit motor drive, one motor drive connected to each central shaft, whereby said central shafts may be rotated thereby rotating said augers.

11. The food and materials dryer of claim 1 wherein said means for directing air for drying through said agitating auger and between said outer shell and said inner lining cylinder of each of said rotary tunnels comprises at least one drying fan unit which directs air for drying opposite the direction in which material is being moved through said inner cylinder.

12. The food and materials dryer of claim 1 further comprising a plurality of cylindrical hollow rotary tunnels arranged in generally stacked relation thereby permitting an efficient utilization of floor space.

13. The food and materials dryer of claim 12 further comprising a plurality of chute means each extending between and connected to a pair of rotary tunnels such that food and material may be transferred between rotary tunnels.

14. The food and materials dryer of claim 1 comprising three rotary tunnels mounted on a frame in coplanar parallel relation, the plane of relation tilted upwards forming an angle of 30°-70° from horizontal, whereby material may enter the topmost rotary tunnel, pass through to a middle rotary tunnel, pass through to a lowermost rotary tunnel and be ejected in substantially completely dried form.

15. The food and materials dryer of claim 1 further comprising heating means for air for drying whereby heated air may be used to improve drying efficiency.

16. The food and materials dryer of claim 15 wherein said heating means, said means for rotating said central shafts and said means for directing air for drying are all adjustable such that the rate of air flow, the temperature of the air and the rate of rotation of each auger may be individually controlled.

17. A food and materials drying comprising:

a plurality of cylindrical hollow rotary tunnels each having a center longitudinal axis, each comprising;

an outer cylindrical shell having an inner surface;

an inner lining cylinder having a wall with inner and outer surfaces and perforations formed in said wall of said cylinder, said inner lining cylinder mounted substantially concentrically within said outer shell, said inner lining cylinder having an outer diameter smaller than the inner diameter of said outer shell whereby air for drying may be directed between said outer shell and said inner lining cylinder and pass through said perforations in said inner lining cylinder for drying material within said inner lining cylinder;

said cylindrical hollow rotary tunnels arranged in generally stacked relation thereby permitting an efficient utilization of floor space;

a plurality of chute means each extending between and connected to a pair of rotary tunnels such that food and material may be transferred between rotary tunnels;

at least one agitating auger having a central shaft and outwardly projecting helical blades mounted on said central shaft, one auger in each of said rotary tunnels, each mounted coaxially with said center longitudinal axis of said rotary tunnel and within said inner lining cylinder;

said helical blades extending outwards to adjacent said inner surface of said inner lining cylinder;

agitating means mounted on each of said agitating augers, said agitating means operative to agitate food within said inner lining cylinder whereby increased drying efficiency is obtained;

means for rotating said central shaft of each of said agitating augers whereby food placed within one of said rotary tunnels may be moved through said inner cylinder generally parallel to said center longitudinal axis towards an end of said rotary tunnel;

means for directing air for drying through said agitating auger and between said outer shell and said inner lining cylinder of each of said rotary tunnels;

air diverting means mounted on one of said inner lining and outer cylinders, said air diverting means mounted between said inner lining and outer cylinders, said air diverting means operative to divert air directed between said outer and inner lining cylinders into and through said perforations in said inner lining cylinder and into said inner lining cylinder for drying material therein, and said air being directed opposite the direction in which food is being moved through said inner cylinder whereby drying efficiency may be increased.

* * * * *